United States Patent [19]

Alexandrov et al.

[11] 4,443,735

[45] Apr. 17, 1984

[54] DIRECTLY HEATED MESHED CATHODE FOR ELECTRONIC TUBES AND METHOD OF MAKING

[76] Inventors: Vladimir N. Alexandrov, Chkalovsky prospekt, 14, kv. 25; Vladimir F. Ioffe, Kirovsky prospekt, 69/71, kv. 5; Oleg V. Filatov, ulitsa Kuibysheva, 1/5, kv. 21, all of, Leningrad, U.S.S.R.

[21] Appl. No.: 308,541

[22] PCT Filed: Dec. 24, 1980

[86] PCT No.: PCT/SU80/00215

§ 371 Date: Oct. 2, 1981

§ 102(e) Date: Oct. 2, 1981

[87] PCT Pub. No.: WO81/02364

PCT Pub. Date: Aug. 20, 1981

[30] Foreign Application Priority Data

Feb. 5, 1980 [SU] U.S.S.R. ..... 2871003

[51] Int. Cl.[3] ..... H01J 1/14; H01J 19/06; H01K 1/14

[52] U.S. Cl. ..... 313/345; 313/341; 313/343

[58] Field of Search ..... 313/341, 343, 345, 342

[56] References Cited

U.S. PATENT DOCUMENTS

| | | | |
|---|---|---|---|
| 2,468,736 | 5/1949 | Butler | 313/341 |
| 2,882,436 | 4/1959 | Dorgelo | 313/343 |
| 3,449,616 | 6/1969 | Sarrois | 313/341 |
| 3,473,073 | 10/1969 | Gerlach | 313/341 |
| 3,806,753 | 4/1974 | Van Warmerdam | 313/341 |
| 3,875,445 | 4/1975 | Bachmann et al. | 313/341 |
| 3,943,398 | 3/1976 | Gerlach | 313/341 |
| 4,144,473 | 3/1979 | Almer | 313/343 |
| 4,230,968 | 10/1980 | Oguro | 313/341 |

*Primary Examiner*—Saxfield Chatmon

*Attorney, Agent, or Firm*—Fleit, Jacobson, Cohn & Price

[57] ABSTRACT

In a directly heated meshed cathode made of one metal piece in the form of a hollow cylinder, the working surface is constituted by intersecting helical filaments 3 and 4 with holes 5 therebetween, each filament 3 and 4 being formed with a stepped increase in the width from periphery to center of the cathode.

A method of making the meshed cathode comprises fabrication of a tool electrode out of a plate by electroerosive cutting of grooves in the end portion of the plate with projections therebetween shaped to match the holes 5 between the filaments 3 and 4, and electroerosive broaching, using this tool electrode, of longitudinal rows of holes 5 in a hollow cylindrical blank rotatably displaced, after each pass of the tool electrode, through an angle equal to twice the angular distance between the center lines of adjacent longitudinal rows of holes 5 in the cathode. The grooves are cut out in the plate so that after each pass of the tool electrode, there are produced in the blank: full holes 5 of one longitudinal row, hole-halves 5' of two rows adjoining thereto, and corresponding sections of the filaments 3 and 4 between these holes 5.

7 Claims, 8 Drawing Figures

DIRECTLY HEATED MESHED CATHODE FOR ELECTRONIC TUBES AND METHOD OF MAKING

FIELD OF THE INVENTION

The present invention relates to vacuum devices, and more particularly to directly heated meshed cathodes for electronic tubes and to methods of making.

DESCRIPTION OF THE PRIOR ART

Directly heated tubular meshed cathodes provide for a large current capability, due to their extensive working area, as compared to directly heated rod cathodes. The existing meshed cathode designs, however, suffer from a number of disadvantages that limit their practical application. The main problems with these cathodes include difficulties in providing uniform emission over the entire working surface, i.e. high cathode efficiency, a long life and cathode parameter stability, as well as technologically effective designs.

Known in the art is a directly heated meshed cathode with a cylindrical meshed structure of the working surface formed by intersecting helical filaments /cf. FRG Pat. No. 851832, 1950/. In this cathode, all the filaments are welded together at intersection points, the ends of the filaments being welded to current-supplying rings.

The method of making such a cathode resides in winding the wire around the cylindrical surface in two directions, welding the wires together at intersections, and welding the wire ends to the current-supplying rings /cf. USSR Inventor's Certificate No. 24491, of 1929/.

The wire meshed cathodes fail to provide a sufficient mechanical strength because of the large number of welds, and besides, uniform heating temperature distribution cannot be obtained. The filament ends welded to the current-supplying rings are colder than the central region of the filaments due to a considerable heat dissipation. Further, the multiple welds cause discontinuities along each filament thus preventing temperature equalization over the entire working surface of the cathode. Nonuniform distribution of temperature over the working surface of the cathode results in turn in a nonuniform emission current. Moreover, in such a cathode, the mutually intersecting wires are differntly spaced from the cathode axis (in two layers). Therefore, it sets a limit on minimizing the grid-to-cathode spacing. As a result, the possibilities of increasing the tube transconductance are limited for the wire cathodes. The manufacturing process of winding the wire with multiple welds is both complicated and low-efficient. Owing to the nonuniform temperature distribution, the low mechanical strength, and the structural discontinuities induced by welding, such cathodes are not practicable enough and have a short life.

There is also known a directly heated meshed cathode for electronic tubes as disclosed in the USSR Inventor's Certificate No. 260748 published in 1968, which serves as a prototype of the present invention. This cathode is made of one metal piece in the form of a hollow cylinder with current-supplying rings provided at its ends, the working surface being confined between the rings and represented by intersecting helical filaments with holes therebetween.

Such a cathode has a higher mechanical strength and manufacturing efficiency than the wire cathode. The efficiency of this cathode is also superior to that of the welded wire cathode. One-piece configuration of the cathode (made of a single pipe) enables the grid and cathode of such a tube to be more closely spaced and a uniform grid-cathode spacing to be provided throughout the entire working surface of the cathode, resulting in a higher transconductance and a wider frequency band of the tube. The cathode may be formed with a varying size of holes between the filaments, so that the area of the holes of each annular row is less than that of the subsequent annular row going in a direction from the periphery of the cathode to the centre thereof. In this case, the total surface area of the filaments in the central region of the cathode is found to be smaller than the area near the current-supplying rings, this difference resulting in some equalization of the emission current density over the cathode surface.

Despite the aforementioned advantageous features of the known one-piece meshed cathode, however, it still suffers from the inherent defect of the known welded wire cathodes in that each helical filament has a higher temperature in the centre than near the current-supplying rings. The temperature drop along the filament as directed from the centre of the cathode towards the rings in the prior art cathode is 400°–500° C., and consequently, the active portion of the working suface of any filament amounts to as little as one-half of its total length. So the area of the effective emitting surface of the cathode serving as a prototype is approximately equal to half its working surface area, thus radically limiting the power takeoff capabilities of the cathode. It is particularly the case for the shorter cathodes with the ratio of the working surface length to the diameter near unity.

The provision of varying size of the holes in the known one-piece metal cathode allows a certain equalization of the integral temperature profile over the cathode surface. But even in this case, a temperature drop along each filament still occurs without any noticeable increase in the cathode efficiency, i.e. the nonuniform distribution of emission over the cathode surface remains. The temperature gradient over the filament length also reduces the useful life of the cathode.

This cathode may be built using a known method of manufacturing meshed electrodes for electronic tubes described in the paper by V. N. Alexandrov and V. F. Ioffe "Novye Konstruktsii setochnykh Blokov generatornykh i modulyatornykh lamp, oborudovanie dlya ikh izgotovlenia" published in the journal "Obmen Opytom v elektronnoi promyshlennosti", Moscow, issue 7 (17), 1968. According to this method, a tool-electrode is first fabricated from a plate with the length of its end portion corresponding to that of the cathode working surface, by electroerosively cutting out grooves in the ends of the plate using a wire electrode, with projections formed therebetween of a shape corresponding to that of the interfilament holes; this tool electrode is then employed for electroerosive broaching of longitudinal rows of holes in the hollow cylindrical blank.

The projections formed in cutting the grooves in the plate are lozenge-shaped in cross section and arranged in a single row along the working surface of the tool-electrode, the width of the plate end machined for making the tool electrode being chosen equal to the diagonal of the lozenge-shaped interfilament hole perpendicular to the cathode axis, minus two electroerosion gaps. As the hollow cylindrical blank is broached by such a tool electrode, one longitudinal row of lozenge-shaped holes is formed after a single pass of the tool. The workpiece is then turned about its axis through an angle equal to the angular distance between the centre lines of adjacent longitudinal rows of holes in the cathode, and shifted along the axis by a length equal to half the other diagonal of the lozenge hole, extending in parallel relation to the generatrix of the cylinder. After broaching a second longitudinal row of holes, the workpiece is rotated through the same angle and shifted along the axis by the same distance in the reverse direction. In this manner, all the longitudinal rows of holes are broached, sequentially rotating the work-piece and displacing it each time along the axis with respect to the tool electrode. The dimensions of the cathode holes are here directly determined by the dimensions of the projections on the working end of the tool electrode, while the dimensions of the filaments are controlled by the angular displacement of the workpiece around the axis and by its axial displacement with respect to the tool electrode.

The aforementioned method of manufacture suffers from a number of faults further aggravating the structural disadvantages of the cathode. Among the primary defects is a very time-consuming process of fabricating the tool electrode of the desired shape, as well as the inherently complicated mechanism of the equipment employed for broaching the holes in the cylindrical blank due to the necessity of providing high precision both of angular and axial displacement of the blank. Since in the known method, the dimensions of the filaments are determined by precision of angular and axial displacements of the blank, each of them contributing its individual error, the manufacture of filaments with the desired accuracy and reproducibility, using this method, presents certain difficulties. The filaments produced have a large spread in width. In operation, additional temperature gradients occur in the cathode manufactured in this manner due to inaccuracies involved in fabricating the filaments, thus resulting in a lower efficiency and a shorter life of the cathode.

DISCLOSURE OF THE INVENTION

It is an object of the present invention to improve emission characteristics and to provide a greater case of manufacture of a directly heated meshed cathode for electronic tubes.

The principal object of the present invention is to provide a directly heated meshed cathode for electronic tubes that, given a particular size, should have a larger area of effective emitting surface due to a more uniform temperature profile of the filaments, and to design a method of making this cathode such as to permit a high-precision formation of filaments using the simplest technology possible.

With this object in view, there are proposed two structural embodiments of the meshed cathode, within the scope of the invention, based on the principle of a stepwise increase in the surface area of each filament from the periphery of the cathode to the centre thereof.

In accordance with the first embodiment, in a directly heated meshed cathode for electronic tubes made of one metal piece and shaped as a hollow cylinder with current-supplying rings provided at the ends thereof and a working surface confined between the rings and formed by intersecting helical filaments spaced by holes, according to the invention, each filament features a stepwise width increase from the periphery to the centre of the cathode.

In accordance with the second embodiment, in a directly heated meshed cathode for electronic tubes made of one metal piece and shaped as a hollow cylinder with current-supplying rings provided at the ends thereof and a working surface confined between the rings and formed by intersecting helical filaments spaced by holes, according to the invention, in the central region of the working surface of the cathode, between the adjacent intersections of the filaments, there are provided bridges to form at least one equipotential ring parallel to the current-supplying rings.

These bridges should preferably form a number of parallel equipotential rings, the width of each ring being in excess of the width of each succeeding ring, looking from the centre to the periphery of the cathode.

An increase in the effective emitting surface of the first embodiment of the cathode structure is due to a higher current density in those filament sections disposed closer to the current-supplying rings, thus ensuring a more uniform heating of each filament throughout the entire length thereof. Further, heat dissipation at the filament ends is caused to be reduced as a result of the smaller width of the filaments adjacent the current-supplying rings.

The larger effective emitting surface in the second embodiment of the cathode structure is due to addition of non-current-carrying bridges forming equipotential rings to the hot filament sections, causing part of the heat in these sections to be transferred to the bridges. This enables the temperature to be equalized along the filaments. The equalization of temperature in the filaments can be kept within close tolerances by adjusting the bridge width so that the widest bridges be connected to the hottest portions of the filament.

Each of the two embodiments of the meshed cathode structure is of equal value from the viewpoint of attaining the end. According to specific conditions encountered in designing the cathode for a particular electronic tube, the designer may select either of the proposed embodiments or a combination thereof, i.e. provide a cathode both with a stepped increase in the filament width and with equipotential rings.

It will be further noted that both of the proposed embodiments assume all the cathode filaments to be of equal length. With one-piece metal cathodes, the cross-section of any filament is near rectangular. The thickness of each filament is uniform along the entire length and the working surface of all the filaments throughout the cathode is equally spaced from its axis.

Also with the aforementioned object in view, in a method of making a directly heated meshed cathode for electronic tubes, including fabrication of a tool electrode out of a plate by electroerosive cutting of grooves in the end portion of the plate by a wire electrode, with projections formed therebetween of a shape corresponding to that of the interfilament holes, the length of the end portion of said plate being machined corresponding to the length of the working surface of the cathode, followed by electroerosive broaching, using this tool electrode, of longitudinal rows of holes in a hollow cylindrical blank rotatably displaced about its axis after each pass of the tool electrode, according to the invention, the width of the plate end being machined is equal to twice the distance between the centre lines of adjacent longitudinal rows of holes in the cathode, and the grooves are cut out in the plates so that after each pass of the tool electrode, there are formed in the hollow cylindrical blank: full holes of one longitudinal row, half-holes of two longitudinal rows adjoining thereto on either side, and two lengths of each filament formed each by intersection between this filament and two other adjacent filaments, each pass of the tool electrode being followed by rotating the blank through an angle equal to twice the angular distance between the centre lines of adjacent longitudinal rows of holes in the cathode.

The proposed method of making a meshed cathode provides a simple means for high-precision fabrication of filaments, since the formation of the elements of the cathode working surface, when using the proposed method, is controlled by the tool electrode, i.e. the dimensions of the filaments are determined by the width of the grooves in the tool electrode and are essentially independent of the accuracy of adjusting the angular displacement of the workpiece.

In addition, the proposed method provides an increase in productivity to at least twice the output provided by the known manufacturing technique, since the number of tool electrode passes, as the working surface is formed by this method, is equal to half the number of longitudinal rows of holes in the cathode.

The invention is further illustrated by a detailed description of its preferred embodiments taken in conjunction with the accompanying drawings.

DESCRIPTION OF THE PREFERRED EMBODIMENTS

The directly heated meshed cathode for electronic tubes, according to the first embodiment of the invention, is formed by a hollow cylinder made of one piece of metal such as tungsten. At both ends of the cylinder there are provided current-supplying rings 1 (FIG. 1) and 2 that confine the working surface of the cathode in the form of a meshed structure of a length L along the generatrix of the cylinder.

The working surface of the cathode is formed by mutually intersecting helical filaments comprising a set of parallel filaments 3 directed along the right helical line and a set of parallel filaments 4 crossing the same and directed along the left helical line. The filaments 3 and 4 are all identical in length and shape, only differing in the direction of the helical lines.

Formed between the filaments 3 and 4 are holes 5 that are lozenge-shaped in the embodiment described.

Figure 1:
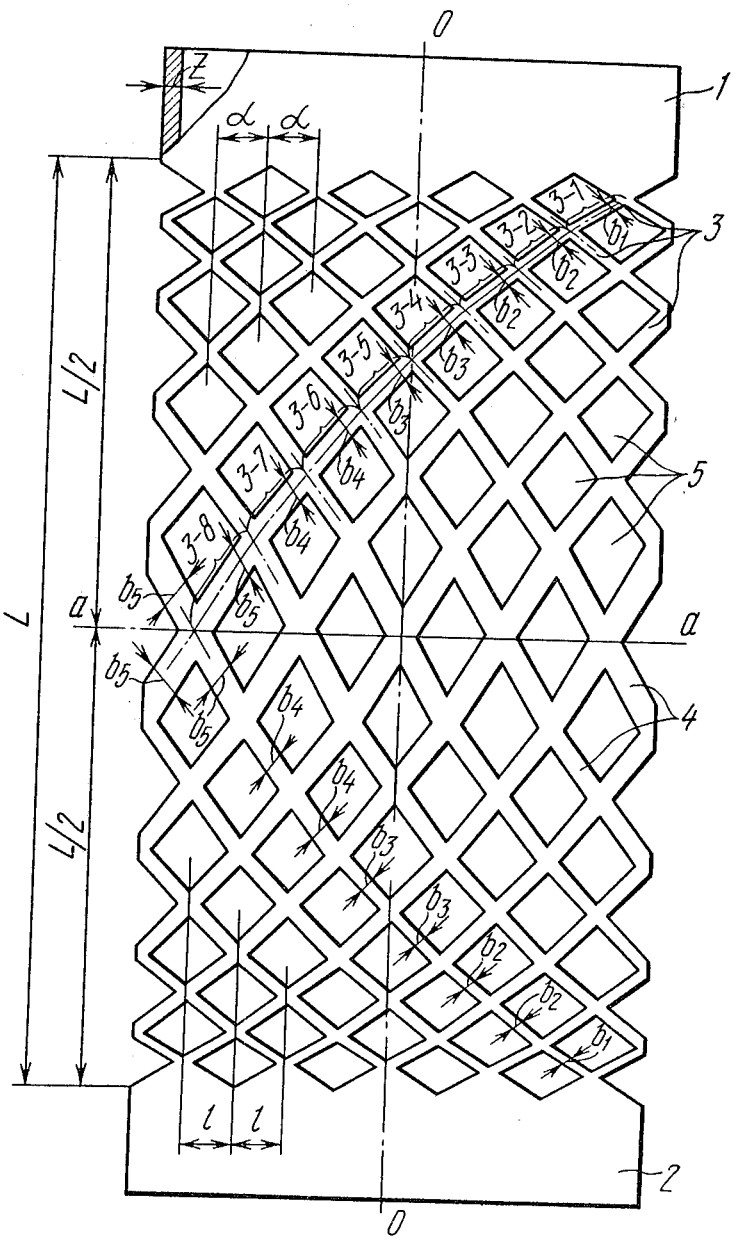
FIG. 1 shows a directly heated meshed cathode for electronic tubes, according to the first embodiment of the invention.

The meshed structure in the form of the filaments 3 and 4 constituting the working surface of the cathode is symmetrical about the centre of the cathode shown as a symbolic plane a—a perpendicular to the axis 0—O of the cathode of FIG. 1.

According to the invention, each filament 3 and 4 is formed with a stepped increase in width looking from the periphery to the centre of the cathode. Since all the filaments 3 and 4 are identical with respect to the central plane a—a of the cathode, one half of the filaments 3 disposed, say, above the central plane a—a will be considered hereinafter as exemplifying all the halves of all the filaments 3 and 4; both the top halves adjacent the current-supplying ring 1 and the bottom halves adjacent the current-supplying ring 2.

The width of the filament 3 is increased stepwise in the direction from the top edge of the cathode, i.e. from the current-supplying ring 1, to the centre a—a.

The portion of the filament 3 closest to the current-supplying ring and formed by the segment 3–1 between the adjacent filaments 4 intersecting this filament 3 has the lowest width $b_1$. The next portion of the filament 3 formed, for example, by the segments 3–2 and 3—3 between two other adjacent filaments 4 intersecting the filament 3 has a width of $b_2$ which is larger than $b_1$ but smaller than the width $b_3$ of the portion of the filament 3 lying farther down to the centre of the cathode and composed of a sequence of segments 3–4 and 3–5; the width $b_3$ of the segments 3–4 and 3–5, in turn, is smaller than the width $b_4$ of the portion of the filament 3 formed by the segments 3–6 and 3–7. The portion of the filament 3 formed by the segment 3–8 closest to the central plane a—a of the cathode has the largest width $b_5$, i.e.

$$b_5 \leqq b_4 \leqq b_3 \leqq b_2 \leqq b_1 = \min$$

Another pattern of increasing the width of the filaments 3 and 4 from periphery to centre is also possible. As known from experience, the width of the filaments need not always be changed along the entire width thereof. At times, it is sufficient that only those portions adjacent the current-supplying rings be made of a smaller width than the remaining part of the filament having a constant width. In some cases, however, it may prove inadequate, necessitating the filament to be formed with several portions of different widths, beginning from the current-supplying rings 1 and 2. In this case, the manufacturing efficiency of the structure is ensured by selecting the length of each filament portion of uniform width equal to two consecutive segments bounded by other filaments intersecting this particular filament, with the exception of the portions immediately adjoining to the current-supplying rings whose length should be preferably limited by one such segment.

For specific cathodes according to the required parameters, the width of the filaments 3 and 4 at each portion is calculated by known procedures considering the material properties, the cathode geometry, the length and number of filaments, the operational modes of the cathodes, etc. This is generally a computer-aided design. Since it is essentially impossible to give an unambiguous estimate of the interrelation between a large number of factors controlling the temperature and emission profile of the cathode surface, the values computed are subject to refinement. Therefore, the optimum dimensions of the cathode elements, in particular, the widths of the filament portions are finally fitted experimentally. This is not a very time-consuming job for those skilled in the art, and it is fully justified, since several experiments result in a cathode of an essentially perfect temperature distribution over the length of any filament.

Figure 2A:
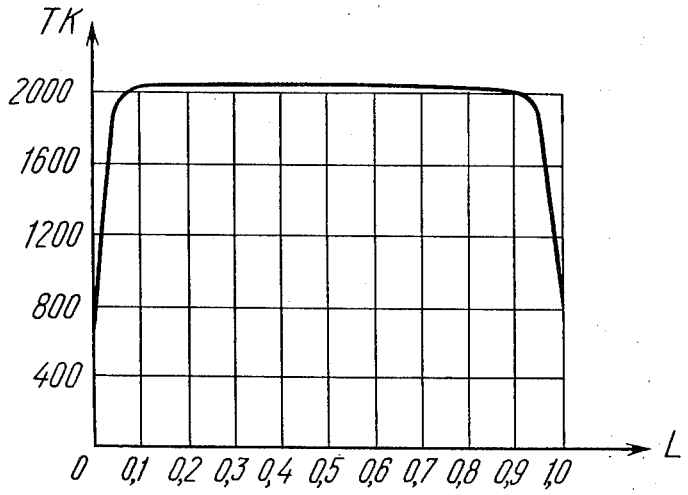
FIGS. 2*a,b* are temperature profiles of the filaments of the cathode shown in FIG. 1 and of the known cathode, respectively.
Figure 2:
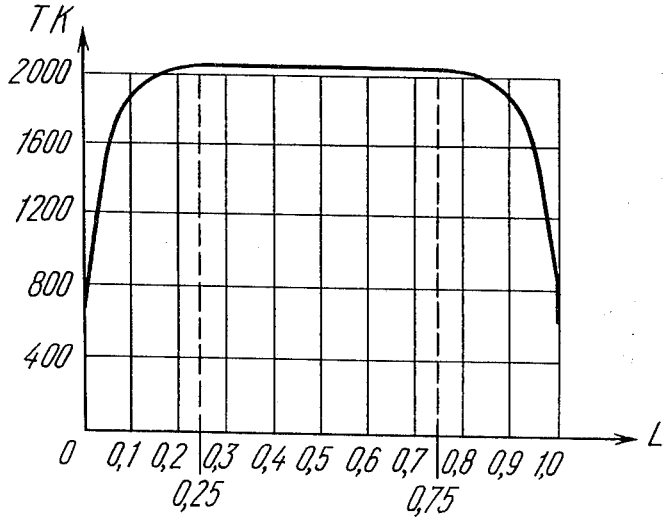

FIG. 2*a* shows a temperature profile throughout the entire length of the working surface for a cathode made of thoriated tungsten, according to the embodiment of the invention described. The measurement results in FIG. 2*a* were obtained by heating the cathode to 2000° K., passing an electric current therethrough, and measuring the temperature at different points of the filament 3 (FIG. 1) and 4. The curve of FIG. 2*a* represents average values for any one filament.

The plot of FIG. 2*b* characterizing the same function for the known meshed cathode as disclosed in USSR Inventor's Certificate No. 260748 is given for comparison. As is apparent from FIGS. 2*a* and 2*b*, thermal distribution along the filament is more uniform for the cathode of the invention than for the known cathode. In the proposed construction of the cathode, the effective emission surface area amounts to more than 80% of the working surface of the cathode, whereas in the known cathode, this area will be less than 50% of the working surface.

Figure 3:
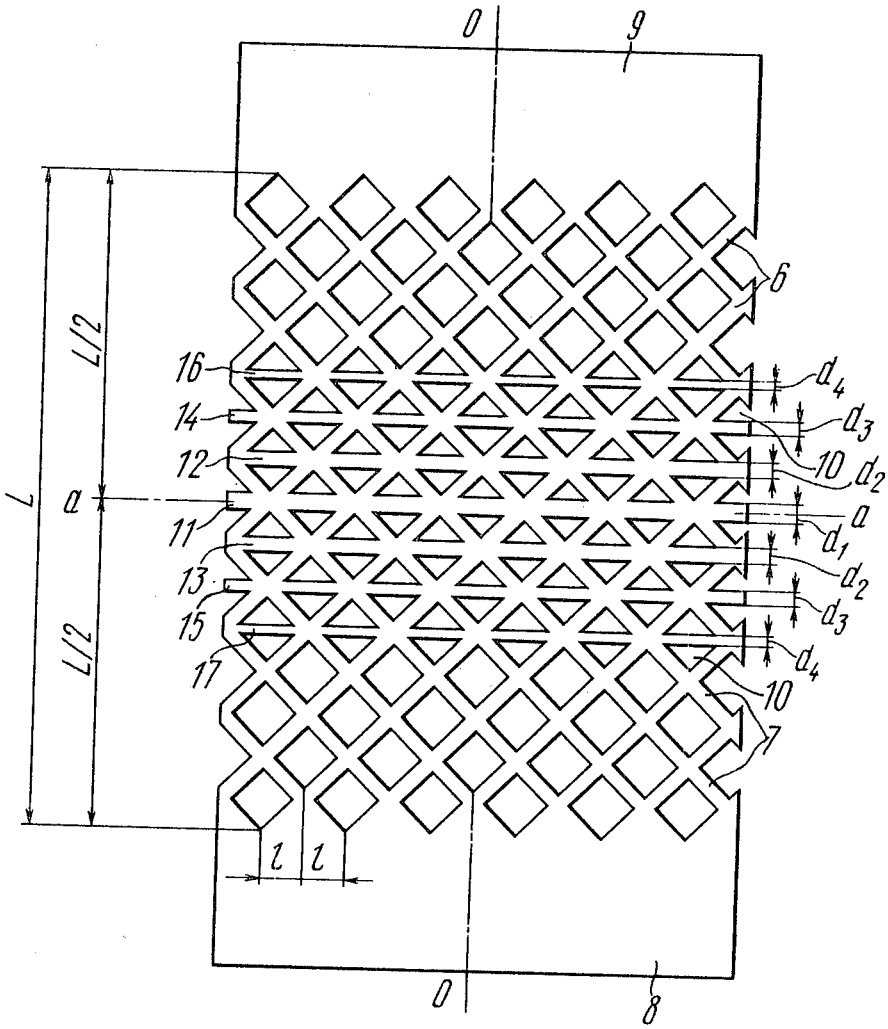
FIG. 3 is a directly heated meshed cathode for electronic tubes, according to the second embodiment of the invention.

FIG. 3 shows another embodiment of the directly heated meshed cathode according to the invention. This cathode has much in common with that shown in FIG. 1, i.e. it is likewise constituted by a one-piece metal cylinder, the working surface of the cathode is formed by helical filaments 6 directed along the righ-handed helical line and intersected by helical filaments 7 directed along the left-handed helical line. The filaments 6 and 7 are confined between current-supplying rings 8 and 9 provided at the cylinder ends. Similarly to the cathode of FIG. 1, the working surface of the cathode of this embodiment is symmetrical about the centre of the cathode, i.e. about the plane a—a passing through the midpoint of the cylinder generatrix perpendicular to its axis O—O, and the filaments 6 and 7 have all identical dimensions. The cathode of FIG. 3 differs from that of FIG. 1 described above in that each filament 6 and 7 has a uniform width over the entire length, and in the central region of the working surface between the nearest intersections of the filaments 6 and 7, in holes 10 therebetween, there are provided bridges constituting equipotential rings, of which one ring 11 is disposed in the centre of the cathode, while the others are arranged in pairs 12 and 13, 14 and 15, 16 and 17 symmetrically about the centre a—a of the cathode. The equipotential rings 11, 12, 13, 14, 15, 16, and 17 are all parallel to the current-supplying rings 8 and 9.

The width of the equipotential rings is dependent on the distance from the centre a—a of the cathode. The ring 11 disposed in the centre of the cathode has the maximum width $d_1$. The width $d_2$ of the succeeding rings 12 and 13 is less than the width $d_1$ of the ring 11; the width $d_3$ of the rings 14 and 15 is less than the width $d_2$ of the rings 12 and 13, respectively; and the width $d_4$ of the rings 16 and 17 which are farthest removed from the centre of the cathode is below the width $d_3$ of the adjacent rings 14 and 13, i.e.

$$d_4 \leqq d_3 \leqq d_2 \leqq d_1 = \max$$

In some cases, e.g. for short cathodes, a single central ring 11 may be sufficient.

The number and width of the equipotential rings is also calculated by known methods using a computer, with the subsequent experimental optimization of the values computed.

The equipotential rings provide uniform temperature over the working surface of the cathode. These rings carrying no current take up part of the heat from all the filaments intersecting the rings, thus minimizing the temperature at filament/ring intersection points and consequently equalizing the temperature throughout the entire length of the filaments.

The temperature profile of each cathode filament of FIG. 3 is similar to that of FIG. 2*a*.

A method of manufacturing a meshed cathode as applied to the structural embodiment of FIG. 1 is now described.

Figure 4:
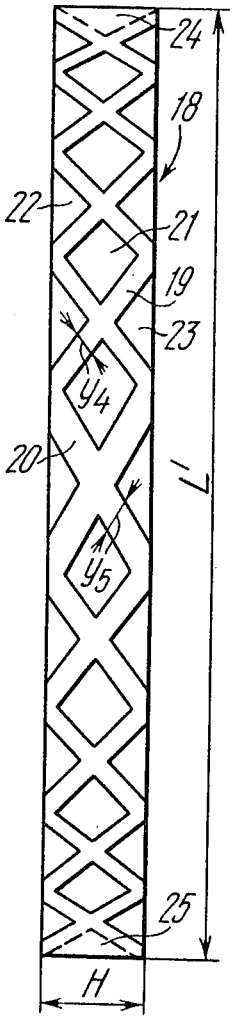
FIG. 4 is a tool electrode for fabrication of the cathode of FIG. 1.
Figure 5:
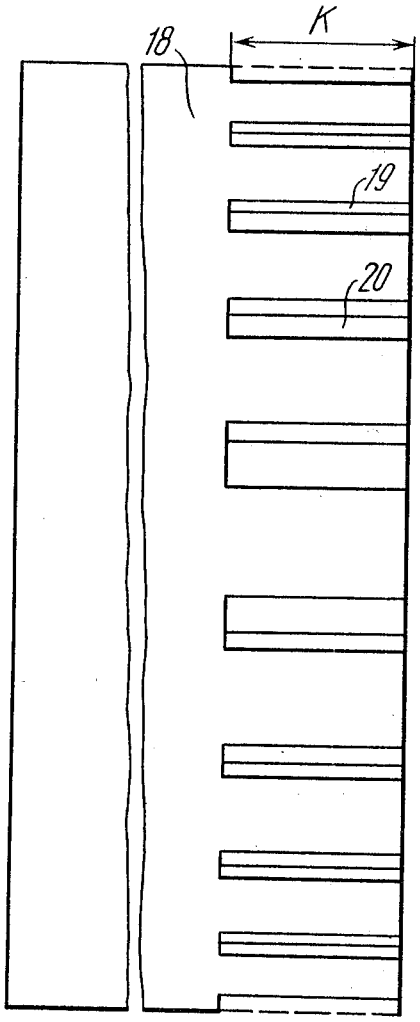
FIG. 5 is a view taken along the arrow A in FIG. 4.

Prior to cathode manufacture, a tool electrode shown in FIGS. 4 and 5 is fabricated. The tool electrode is made of a copper plate 18. The length L′ of the end face of the plate 18 is selected depending on the length L of the working surface of the cathode: $L' = L - 2x$, where "x" is the width of the electroerosion gap. The width "H" of the end face of the plate 18 is chosen to be twice the distance "1" between the centre lines of adjacent longitudinal rows of the cathode holes 5 (FIG. 1).

Mutually intersecting grooves 19 and 20 are cut out by a wire electrode in the end portion of the plate 18 (FIGS. 4 and 5) using electroerosion method. The width and arrangement of each of the grooves 19 and 20 correspond to those of that one section of the filament 3 (FIG. 1) or 4 of the cathode formed by two consecutive segments bounded by other filaments intersecting this particular filament. The choice of the width $Y_n$ of each groove 19 (FIG. 4) and 20 is based on the condition $Y_n = b_n + 2x$, where $b_n$ is the width of the corresponding region of the filament 3 (FIG. 1) or 4, and "x" is the width of the electroerosion gap. The grooves 19 (FIG. 4) and 20 of different widths are cut out either by the wires of a varying diameter or by the wire of the same diameter with varying manufacturing techniques, or else displacing it within the groove following a predetermined program.

The depth "K" of the grooves 19 and 20 is determined from the condition $K \geqq z\,N/2$, with "Z" the wall thickness of the blank for the cathode, and "N" the number of longitudinal rows of holes 5 (FIG. 1) in the meshed structure of the cathode. The degree of wearout of the tool electrode is also taken account of in selecting the depth "K" of the grooves 19 (FIG. 4) and 20.

After all the grooves 19 and 20 have been cut out in the end portion of the plate 18, three longitudinal rows of projections 21, 22, 23 are found to exist between these grooves. Now the projections 21 of the middle row correspond, in cross section, to the full holes 5 (FIG. 1) of one longitudinal row of the cathode holes, while the projections 22 (FIG. 4) and 23 of the end rows correspond to halves of holes 5′ (FIG. 1) of the row adjacent to the first longitudinal row of cathode holes (allowing for electroerosion gaps).

As clearly seen from FIG. 4, when the grooves 19 and 20 are cut, triangular lugs 24 and 25, shown as dashed lines, are formed near the short sides of the rectangular end face of the plate 18. These lugs are to be removed, since they are liable to be displaced on account of their insufficient rigidity, thus resulting in a lower accuracy of fabrication of the most critical regions of the filaments adjacent the current-supplying rings.

If the tool electrode is manufactured from a more rigid material such as steel or titanium, the lugs 24 and 25 may be left. In this latter case, the meshed structure of the cathode will have an appearance different from that shown in FIG. 1.

Further, a hollow cylindrical blank 26 (FIG. 6) is taken; its length and diameter corresponding to the required length and diameter of the cathode, respectively, and the thickness of the walls being equal to the specified thickness "z" of the cathode filaments. Longitudinal rows of holes are sequentially broached in this blank 26 by means of the prefabricated tool electrode shown in FIGS. 4 and 5 using electroerosion technique. In the course of a single pass of the tool electrode, the full holes 5 (FIG. 6) of one longitudinal row are caused to be formed in the blank 26 (FIG. 6) by the projections 21 (FIG. 4), while the hole-halves 5' (FIG. 6) of two rows adjoining to that row on both sides are formed therein by the projections 22 (FIG. 4) and 23.

Figure 7:
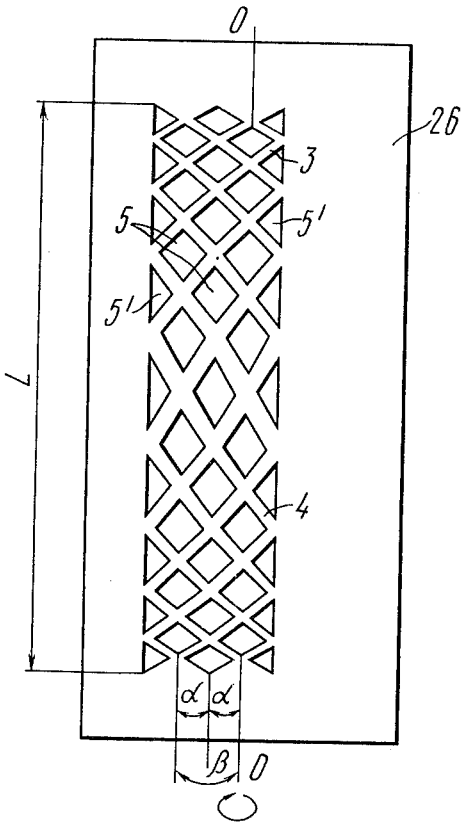
FIG. 7 is the same blank after the second pass of the tool electrode of FIGS. 4, 5.

The blank 26 is then rotated around its axis through an angle of $\beta$ (FIG. 7) equal to twice the angular distance $\alpha$ (FIG. 1) between the centre lines of the holes 5 of adjacent longitudinal rows. Again this is followed by forming, within a single pass of the tool electrode, the full holes 5 of one longitudinal row and the hole-halves 5' of two rows adjoining thereto on both sides, as shown in FIG. 7. Consequently, the hole halves 5' of the row disposed between the rows of the full holes 5 obtained within the first and second consecutive passes of the tool electrode are made complete, so that three rows of full holes are found after the second pass of the tool electrode.

The process described is repeated in the same sequence until the whole structure of the cathode working surface of FIG. 1 is ultimately formed.

Figure 6:
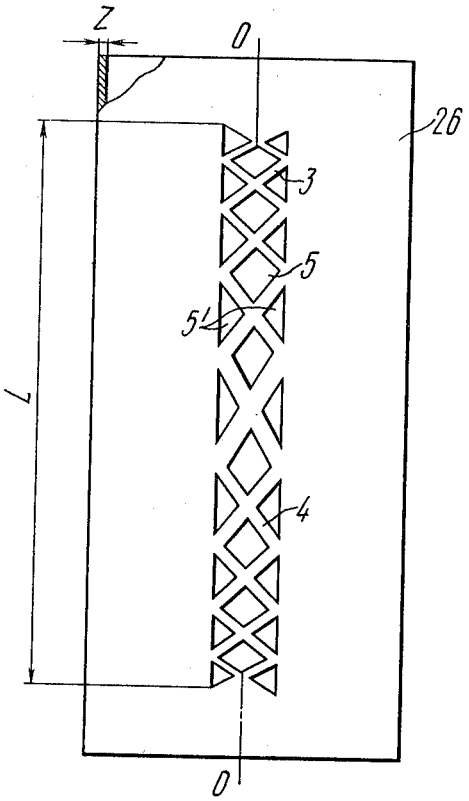
FIG. 6 is a cylindrical blank for the cathode after the first pass of the tool electrode of FIGS. 4, 5.

When the longitudinal rows of holes 5 are broached in the blank 26, as shown in FIGS. 6 and 7, the dimensions of the sections of the filaments 3 and 4 are essentially not dependent on the accuracy of rotation of the blank 26; rather, they are directly determined by the dimensions of the grooves 19 and 20 (FIGS. 4 and 5) of the tool electrode that can be maintained within close tolerances considering the present state of the art of electroerosion technology using a nonshaped wire electrode.

The meshed cathode shown in FIG. 3 is manufactured in a similar fashion, except that in producing the tool electrode, all the intersecting grooves are cut to the same width, and additional grooves of a varying width are cut out in parallel relation to the shorter sides of the end face of the plate 18 (FIG. 4) to form bridges constituting the equipotential rings 11 to 17 (FIG. 3).

The machining regime in fabrication of the tool electrode and formation of the cathode structure is selected following an accepted procedure as applied to specific needs, and also accounting for capabilities of the equipment employed.

INDUSTRIAL APPLICABILITY

The invention can be extensively used in electrovacuum industry for manufacture of generator and modulator tubes. The embodiments of the meshed cathodes described above enable the efficiency of the directly heated meshed cathodes to be increased by a factor of 1.3 to 1.5. In order that the same emission current values be achieved that occur in the existing cathode designs, a smaller specific heating power will be required, and consequently, a lower filament temperature. As a result, the useful life of the proposed cathode is 3 to 5 times as long as that of the known designs. The implementation of the invention opens the way to providing very reliable, low-cost, and long-lived electronic tubes.

We claim:

1. A directly heated meshed cathode for electronic tubes, said cathode being made of one piece of metal in the form of a hollow cylinder with integrally formed current-supplying rings provided at respective ends thereof and a perforated working surface defined between the rings by intersecting incandescent filaments spaced by rhomboidal holes, each of the filaments having the form of a spiral conductor interconnecting the respective current-supplying rings, and each of the incandescent filaments constituting a series of successive lengths, each of which being restricted by intersections of said incandescent filament and two other incandescent filaments, each of the spiral incandescent filaments having a discretely varying cross-sectional area along said successive lengths for which purpose each length of the incandescent filaments has at least one step-wise increase in width in a direction from each of the current-supplying rings toward the middle of said incandescent filament.

2. A method cathode as claimed in claim 1, wherein each two adjacent lengths of each of the incandescent filaments, except for the lengths immediately adjoining the current-supplying rings, form portions having a constant width which is greater than the width of said lengths immediately adjoining the current-supplying rings.

3. A meshed cathode as claimed in claim 2, wherein the width of each of said portions of the incandescent filament is greater than the width of the preceding portion of said incandescent filament in the direction from the current-supplying rings toward the middle of the filament.

4. A directly heated meshed cathode for electronic tubes, said cathode being made of one piece of metal in the form of a hollow cylinder with current-supplying rings provided at respective ends thereof and a perforated working surface defined between the rings by intersecting incandescent filaments spaced by rhomboidal holes, each of the filaments having the form of a spiral conductor interconnecting the respective current-supplying rings, and each of the incandescent filaments constituting a series of successive lengths, each of which being restricted by intersections of said incandescent filament and two other incandescent filaments, each of the spiral incandescent filaments having a discretely varying cross-sectional area along said successive lengths, for which purpose the width of each length of the incandescent filaments is discretely increased near the intersection of the incandescent filaments by at least one bridge being formed from the same piece of metal and being peripherally spaced between respective intersections of the spiral incandescent filaments, said bridges forming at least one equipotential ring which is parallel to the current-supplying rings and equally spaced from said current-supplying rings.

5. A meshed cathode as claimed in claim 1 including a plurality of bridges constituting parallel equipotential rings, the width of each of said bridges being greater than the width of a successive bridge in the direction from the middle of the incandescent filaments toward the current-supplying rings.

6. A method of making a directly heated meshed cathode for electronic tubes comprising the steps of:

making an electrode tool by performing rhomboidally-shaped projections in the working end of a rectangular metal plate having the length of the working end corresponding to the length of the working surface of the cathode being manufactured;

using the electrode tool thus obtained to broach longitudinal rows of holes in a hollow cylindrical blank of the cathode by electric erosion, passing said tool parallel to the axis of said blank while also moving said tool radially in the course of the broaching operation relative to the cathode blank;

turning said blank periodically about the axis thereof following every pass of the electrode tool; said method further comprising the steps of:

selecting said rectangular metal plate so that the width of its working end is equal to the double distance between the middle lines of the adjacent longitudinal rows of holes in the cathode being manufactured; and said projections, cutting blind intersecting grooves in the working end of said plate with a width and location pattern corresponding to the width and location pattern of portions of the incandescent filaments of the cathode being manufactured; thereby to broach open holes in said cathode blank so that following each pass of said electrode tool, full holes of one longitudinal row, a half of the holes of the two longitudinal rows adjoining it on both sides thereof are formed in the cathode blank simultaneously with portions of incandescent filaments of the cathode, spaced by the formed holes and each consisting of filament lengths, each of which being restricted by the intersections of said incandescent filament with two other filaments, said cathode blank being turned in the turning step, following each pass of said electrode tool, about its axis through an angle equal to twice the angular distance between the middle lines of the longitudinal rows of holes in the cathode being manufactured.

7. A method as recited in claim 6 wherein, during the forming step, said electrode tool is formed by electric erosion using a wire electrode.

* * * * *